United States Patent [19]

Koble, Jr.

[11] Patent Number: 4,856,971

[45] Date of Patent: Aug. 15, 1989

[54] EVAPORATIVE COOLER PUMP APPARATUS

[76] Inventor: Robert L. Koble, Jr., 1011 W. Picadilly, Phoenix, Ariz. 85013

[21] Appl. No.: 245,026

[22] Filed: Sep. 16, 1988

[51] Int. Cl.[4] ..... F04D 7/02

[52] U.S. Cl. ..... 417/423.8; 417/423.14; 417/424.1; 310/58; 415/119; 415/121.2; 415/206

[58] Field of Search ..... 417/368, 423.3, 423.8, 417/423.14, 424.1, 372; 310/58; 415/206, 121 G, 119, 168

[56] References Cited

U.S. PATENT DOCUMENTS

| | | | |
|---|---|---|---|
| 2,459,312 | 1/1949 | Essick | 417/423.15 |
| 3,046,900 | 7/1962 | Pollak | 417/423.3 |
| 3,260,214 | 7/1966 | Goettl | 415/121 G |
| 3,397,644 | 8/1968 | Einerson et al. | 415/121 G |
| 3,407,739 | 10/1968 | Myers | 417/423.14 |
| 3,458,739 | 7/1969 | Zelinski et al. | 310/62 |

*Primary Examiner*—Carlton R. Croyle
*Assistant Examiner*—David W. Scheuerman
*Attorney, Agent, or Firm*—H. Gordon Shields

[57] ABSTRACT

Evaporative cooler pump apparatus includes a generally round housing having a plurality of slots on the bottom of the housing which provides the function of an integral screen for the pump to screen out debris and which provides the function of absorbing vibration or dampening vibration to prevent motor vibration from being transmitted to the evaporative cooler in which the pump is disposed. The pump apparatus further includes a circular housing for the pump motor, and may include a wall above the pump motor separating the pump motor from a blower disposed above the motor. Cooled air is drawn upwardly over the motor and is expelled outwardly.

24 Claims, 2 Drawing Sheets

EVAPORATIVE COOLER PUMP APPARATUS

BACKGROUND OF THE INVENTION

1. Field of the Invention:

This invention relates to pumps, and, more particularly, to pumps for evaporative coolers.

2. Description of the Prior Art:

There are generally two types of cooler pumps in the prior art, and they are distinguished by the particular type of motor involved. The two types of motor include a symmetrical, two pole motor, and a one pole or "C" frame, offset motor. Generally, both types of motors include some type of fan or paddle blades for circulating cooling air over the motor. In most cases, cooling air is pulled or pushed downwardly over the motor. This is a relatively inefficient cooling method because the air moves counter to the natural convection of rising warm air. Moreover, the fan blades or paddles are relatively inefficient in themselves, and they generally beat or push the air more than they contribute to a smooth flow of cooling air.

For straining debris from the pump, the pump is generally disposed within a basket of some kind. Either a metal screen or a mesh screen is employed for such purposes.

Evaporative cooler pumps are normally disposed on the bottom or pan of an evaporative cooler. The pan is typically made of steel or plastic. The alternating current hum of the pump motor causes vibration, and the vibration is passed to the evaporative cooler. Since the pump is disposed on the bottom of the cooler, pump vibration is passed to the cooler. The cooler acts as a sound board to transmit the vibration to the duct system to which the cooler is connected. There essentially is no vibration dampening of the evaporative cooler pump.

The apparatus of the present invention overcomes the three above-described separate problems by providing an efficient cooling system for the cooler pump motor, by providing an integral screen for straining debris to prevent the debris from clogging the pump motor, and by providing vibration dampening elements for dampening the vibration of the motor. Moreover, the apparatus includes anti-vortex fins to prevent vortices from forming about the pump impeller.

SUMMARY OF THE INVENTION

The invention described and claimed herein comprises an evaporative cooler pump having a round motor housing. Air is drawn upwardly over the motor and is blown outwardly from the pump housing. The housing in which the motor is disposed is generally circular or round for the efficient handling of the cooling air for the motor.

The apparatus of the present invention includes a plurality of slots at the bottom of the cooler pump and about the water intake for providing the dual functions of water straining and vibration dampening. The slots are relatively close together and are relatively narrow. They thus provide an efficient strainer system for preventing debris from getting into the pump water inlet. At the same time, the slots act as a vibration dampening system for dampening the vibrations of the electric motor.

Among the objects of the present invention are the following:

To provide new and useful evaporative cooler pump apparatus;

To provide new and useful air flow system in an evaporative cooler pump;

To provide new and useful apparatus for circulating cooling air over an evaporative cooler pump motor;

To provide an integral water strainer in an evaporative cooler pump;

To provide a new and useful evaporative cooler pump having a plurality of slots for straining intake water;

To provide a new and useful evaporative cooler pump apparatus having a plurality of slots for dampening the vibration of the cooler pump motor;

To provide new and useful pump apparatus having anti-vortex fins for preventing vortices in the water at the pump impeller;

To provide a new and useful round motor housing for a C-frame pump motor;

To provide new and useful vibration dampening elements in an evaporative cooler pump; and To provide new and useful pump apparatus having an integral water straining system and vibration dampening system and a circular motor housing for an offset or C-frame motor.

DESCRIPTION OF THE PREFERRED EMBODIMENT

Figure 1:
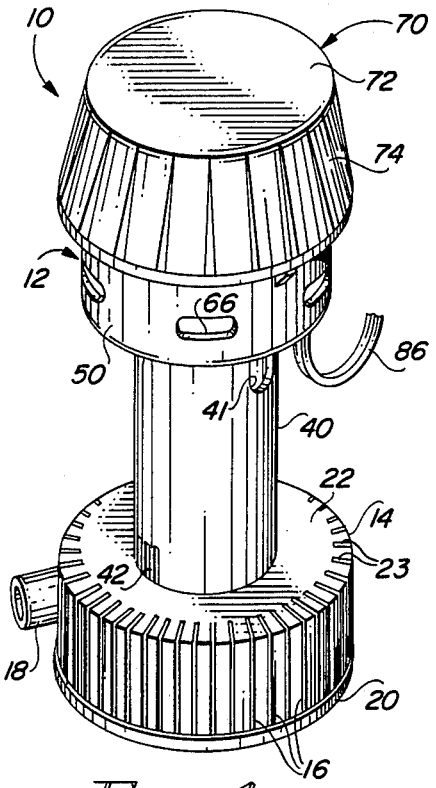
FIG. 1 is a perspective view of the apparatus of the present invention.

FIG. 1 is a perspective view of pump apparatus 10 of the present invention. The pump apparatus illustrated in FIG. 1 includes a housing 12 and a cap 70 disposed on the housing 12. The housing 12 generally includes a lower or bottom water intake portion 14, a cylindrical shaft housing portion 40, and an upper motor housing portion 50. The shaft housing portion 40 is disposed between and connects the water intake portion 14 and the motor housing portion 50. The cap 70 is disposed on and secured to the motor housing 50.

Figure 4:
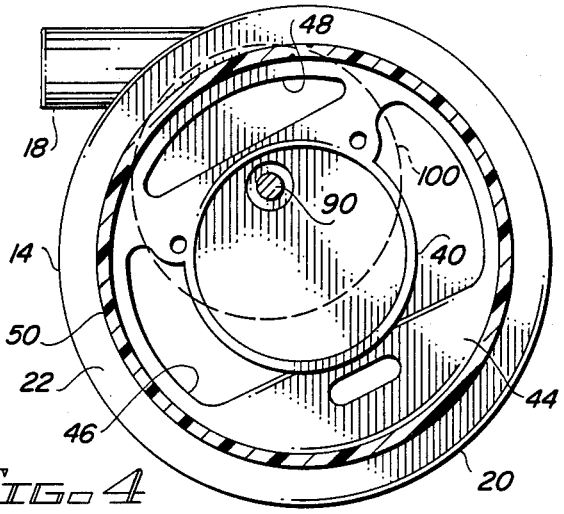
FIG. 4 is a view in partial section taken generally along line 4—4 of FIG. 3.
Figure 3:
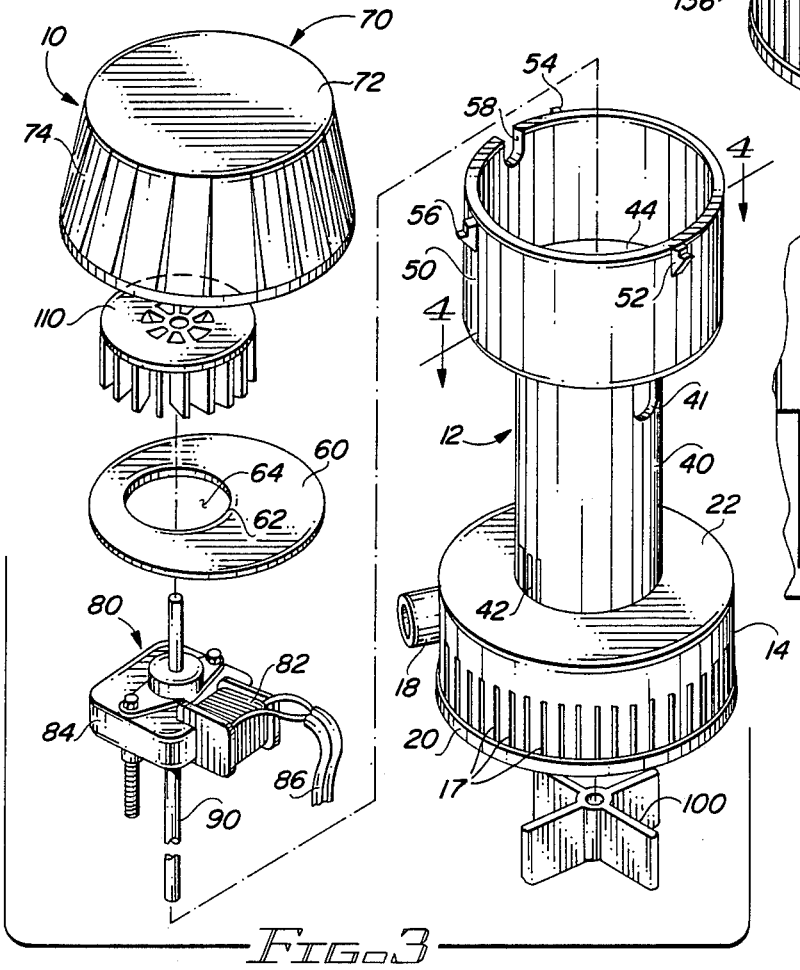
FIG. 3 is an exploded perspective view of the apparatus of the present invention.
Figure 5:
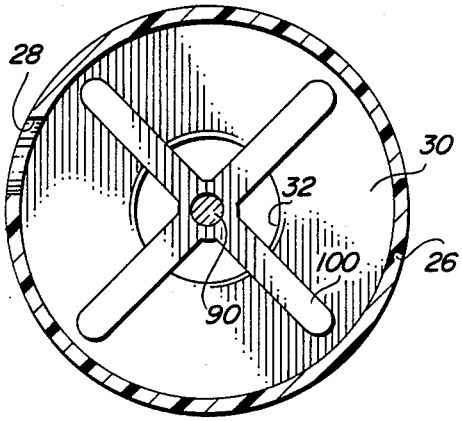
FIG. 5 is a view in partial section taken generally along line 5—5 of FIG. 2.
Figure 2:
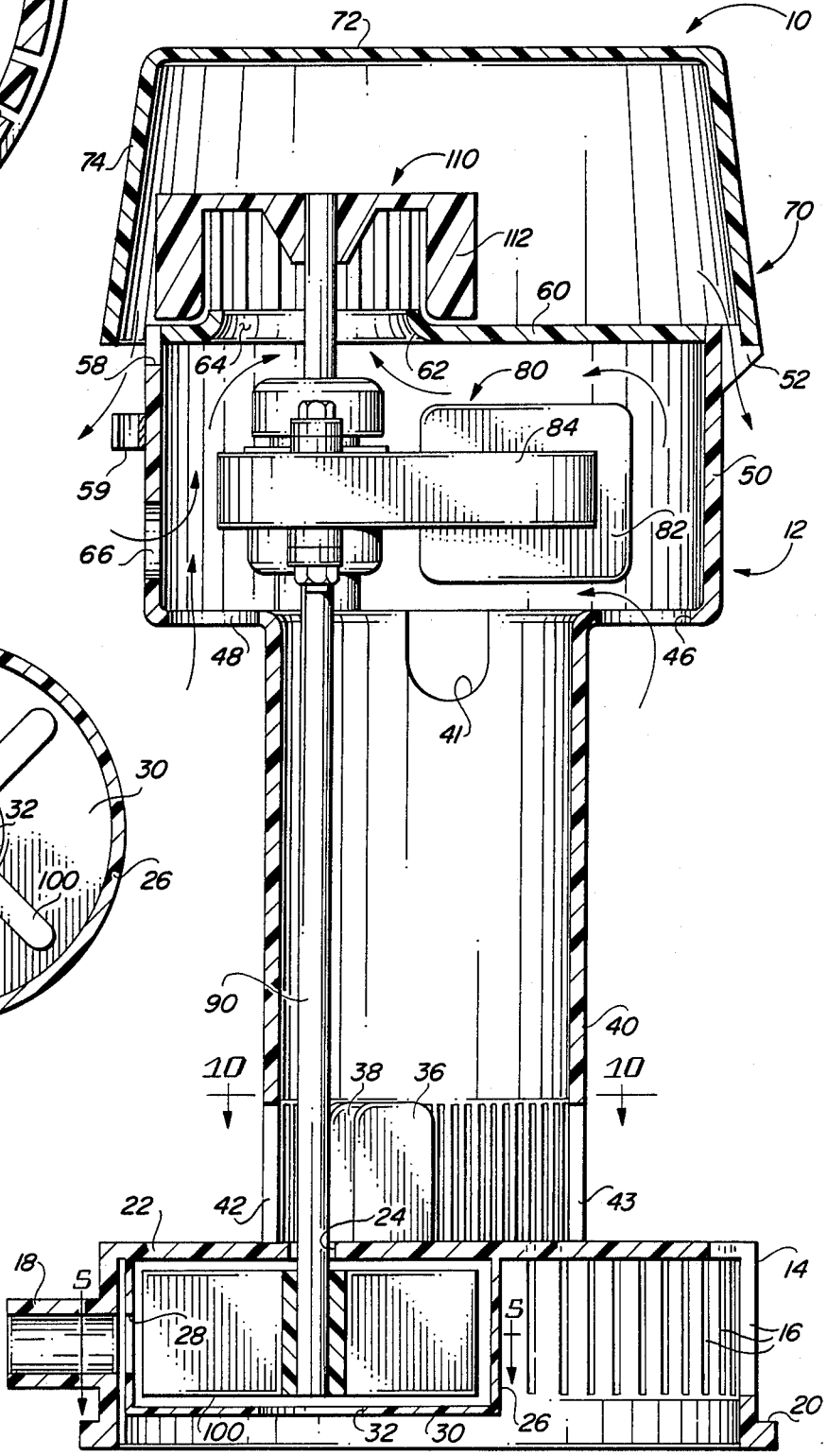
FIG. 2 is a view in partial section of the apparatus of the apparatus of the present invention.

FIG. 2 is an enlarged view in partial section through the pump apparatus 10. FIG. 3 is an exploded perspective view of the pump apparatus 10, with the various elements separated from each other. FIG. 4 is a view in partial section through a portion of the motor housing 50, taken generally along line 4—4 of FIG. 3. FIG. 5 is a view in partial section taken generally along line 5—5 of FIG. 2. For the following general discussion, reference will primarily be made to FIGS. 1, 2, 3, 4, and 5.

The water intake portion or pump base 14 of the housing 12 includes a bottom rim 20. The bottom rim 20 comprises a relatively short, outwardly extending flange connected to the cylindrical water intake portion 14. The water intake portion 14 comprises, with the rim 20, the base for the pump apparatus 10. Extending vertically on the water intake portion base 14 is a plurality of water intake slots 16. At the top of the pump base 14 is a horizontal wall 22. The horizontal wall 22 comprises a base wall for the generally cylindrically configured shaft housing 40.

It will be noted that the water intake housing 14 of FIG. 3 includes a plurality of water intake slots 17. The slots 17 differ from the slots 16 of FIG. 1 in that the slots 16 of FIG. 1 extend vertically and then join with horizontally extending slots 23, while the slots 17 extend only vertically. The slots 16, 23 and 17 will be discussed in detail below.

An opening 24 extends through the horizontal wall 22. An impeller housing 26 extends downwardly from the horizontal wall 22 coaxially aligned with the opening or aperture 24. The impeller housing 26 comprises a cylindrical wall extending downwardly from the horizontal wall 22. Accordingly, a portion of the horizontal wall 22 is also the top wall for the housing 26.

As best shown in FIG. 2, the impeller housing is not slotted. That is, the slots 23 that extend inwardly on the wall 22 from the slots 16 do not extend into the portion of the wall 22 that comprises the top wall for the impeller housing 26. This may also be understood from FIG. 1, which shows the slots 23 extending radially inwardly various distances so as to terminate before the impeller housing.

Extending outwardly from the pump base 14 is a pump outlet 18. The pump outlet 18 communicates with the interior of the base 14, and with the impeller housing 26. The outlet 18 receives water pumped by an impeller 100 within the housing 26. An opening 28 in the housing 26 is disposed adjacent to the outlet 28. Water flows from the housing 26 through the outlet 28 to the nozzle 18.

The bottom of the impeller housing 26 is closed by a bottom cap 30. An opening 32 in the cap 30 allows water from within the base 14 to flow into the impeller housing 26. The water is then pumped by the impeller 100 out of the housing 26 through the opening 28 and into the outlet 18.

Figure 10:
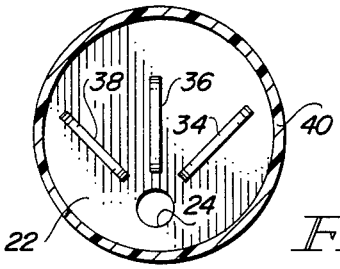
FIG. 10 is a view in partial section taken generally along line 10—10 of FIG. 2.

A plurality of anti vortex fins 34, 36, and 38 extend upwardly from the horizontal wall 22. The fins 34, 36, and 38 are best shown in FIG. 10. FIG. 10 is a view in partial section taken generally along line 10—10 of FIG. 2. The purpose of the fins 34, 36, and 38 is to prevent vortices from forming. Without anti vortex fins, vortices normally form around the pump impeller. The vortices allow air to be introduced into the impeller housing 26 and then into the water pumped out of the apparatus 10. This is, of course, an undesirable situation. The fins 34, 36, and 38 prevent vortices from forming but allow water to flow through the aperture or opening 24 into the impeller housing 26.

The cylindrical shaft housing 40 extends upwardly from the horizontal wall 22 of the water intake portion 14 of the housing 12. The shaft housing 40 includes a pair of slotted openings 42 and 43. The slotted openings 42 and 43 extend upwardly from the horizontal wall 22. The slotted openings 42 and 43 are disposed diametrically opposite each other and are generally aligned with the outlet 18 for convenience in molding or manufacturing the housing 12.

The slotted openings 42 and 43 are similar to the slots 16 in that they each comprise a plurality of vertically aligned slots. The slots allow water to flow into the housing 40, and the slots are closely spaced so as to screen debris, etc.

At the top of the cylindrical shaft housing 40 is a horizontal wall 44. The horizontal wall 44 includes a plurality of air intake openings, including air intake openings 46 and 48, best shown in FIGS. 2 and 4. The wall 44 extends outwardly from the top of the shaft housing 40. The wall 44 comprises a bottom wall for the motor housing 50.

The shaft housing 40 also includes an opening 41 adjacent to the wall 44. The opening 41 allows air to flow into the housing 40 and into the housing 50. There may be another opening, not shown, in the housing 40 diametrically opposite from the opening 41.

The cylindrical motor housing 50 is of a substantially larger diameter than the shaft housing 40. The cylindrical motor housing 50 includes three cap support flanges. The cap support flanges include a flange 52, a flange 54, and a flange 56. The flanges are best shown in FIG. 3.

Extending downwardly from the top of the motor housing 50 is a notch 58. The notch 58 cooperates with a strain relief clamp for an electrical cord 86, which will be discussed below. Below the notch 58 is a strain relief cord clamp. One flange 59 of the cord clamp is shown in FIG. 2. The cord clamp holds the cord 86 against the wall of the housing 50 and beneath the cap 70.

A plate 60 is disposed on the top of the motor housing 50. The plate 60 comprises a top wall for the motor housing 50.

Eccentrically disposed with respect to the plate 60 is a coved wall 62. The coved wall 62 is a relatively short, upturned wall which comprises a rim, or defines a rim, for an opening 64. The opening 64 comprises an air communicating duct between the motor housing 50 and the interior of the cap 70.

A plurality of openings or apertures 66 extend through the wall of the housing 50. The purpose of the apertures or openings (holes) is to allow cooling air to flow into the interior of the housing 50 and over the motor disposed therein. In FIG. 2, arrows show the path of the cooling air through the openings 46 and 48 and 66.

The cap 70 includes a top plate or wall 72 and a generally downwardly and outwardly extending skirt 74. As best shown in FIGS. 1 and 3, the skirt 74 may be fluted for strength and for decorative purposes on its outer surface, if desired. The interior of the cap 70 should be as smooth as possible for air flow purposes.

The skirt 74 is disposed on the three cap support flanges 54, 56, and 58. As best shown in FIG. 2, there is a radial space between the housing 50 and the bottom of the skirt 74. Air flows out of the cap 70 through the space.

Within the motor housing 50 is a motor 80. The motor 80, best shown in FIGS. 2 and 3, is referred to as a C-frame or as an offset motor. The term "offset" refers to the fact that the motor is not symmetrical. Rather, the motor 80 includes a single coil 82. A core 84 extends through the coil 82. The coil 82 is offset from an output shaft 90 of the motor 80.

The electrical cord 86, best shown in FIG. 3, is appropriately connected to the coil 82. Details of the motor 80, its electrical components or elements, including the connection of the core 86, etc., have been omitted. Such are well known and understood in the art. Similarly, the securing of the motor to the housing 50 has been omitted for clarity because such is well known and understood in the art.

In FIG. 1, the cord 86 is shown extending through a hole in the bottom of the wall 44 (see FIG. 4). In FIGS. 2 and 3 there is shown the notch 58. Obviously, the cord 86 may extend out of the pump apparatus 10 in any convenient manner.

The output shaft 90 extends through the motor 80 both above and below the motor 80. The pump impeller 100 is secured to the bottom of the shaft 90 and an air moving element, such as a blower wheel 110, is secured to the top of the shaft 90. This is best shown in FIG. 2. The shaft 90 extends downwardly from the motor 80 and through the cylindrical housing 40, and through the aperture 24 in the horizontal wall 22. Beneath the horizontal wall 22, the shaft 90 is secured to the pump impeller 100. As best shown in FIG. 2, the pump impeller 100 and its housing 26 are also offset from the center of the pump apparatus 10 due to the offset nature of the motor 80.

The motor 80 is appropriately secured to the wall 44 in a well known manner.

The upper portion of the shaft 90 extends concentrically or coaxially through the opening 64 and accordingly through the coved wall 62 of the plate 60 and into the cap 70. Also as best shown in FIG. 2, the blower wheel 110 is secured to the top of the shaft 90. The blower wheel 110 includes a plurality of blades 112. The blades 112 are disposed radially adjacent to the coved wall 62. That is, the coved wall 62 extends upwardly a relatively short distance above the bottom of the blades 112 of the blower wheel 110. The blower blades 112 accordingly are disposed radially outwardly from, and extend a short distance downwardly below, the wall 62.

In operation, water flows through the water intake slots 16 into the interior of the water intake portion 14 of the housing 12 and through the opening 32 into the impeller housing 26. Water may also flow into the housing 26 through the slotted openings 42 and 43 into the lower portion of the shaft housing 40 and through the opening 24 in the horizontal wall 26.

With electrical power connected through the cord 86 to the motor 80, both the pump impeller 100 and the blower wheel 110 will be rotating. The pump impeller 100 pumps the water flowing into the impeller housing 26 outwardly through the opening 28 and the pump outlet 18.

Rotation of the blower wheel 110 causes air to be drawn upwardly through the apertures or intake openings 46 and 48 in the wall 44, through the opening 41 in the shaft housing 40, and through the openings 66 in the motor housing 50. The air flows upwardly, over the motor 80, and into the cap 70 through the opening 64. The air in turn flows outwardly from the cap 70 in the space between the cap 70 and the motor housing 50.

As best shown in FIG. 2, there is a space between the skirt 74 and the pump housing 50. Large arrows in FIG. 2 generally show the path of the air from outside the pump apparatus 10, through the openings 46, 48, and 66, over the motor 80, through the opening 64, and out of the cap 70.

It will be noted that while the blower wheel 110 is a true blower wheel, in the generic sense of the term, the pump impeller 100 is simply a four-bladed paddle, or the like. It may have more or less than four blades, if desired. However, a four-bladed impeller has proved to be satisfactory for typical applications. Moreover, the blower wheel 110 may be simply any appropriate element for moving the air. Typically, a four bladed air moving element may be used.

If desired, the plate 60 may be omitted. If other than a blower wheel is used to move the cooling air, the plate 60 may not be needed and/or may not be advantageous to use.

The primary concept of the apparatus of the present invention is the utilization of a circular motor housing and cap for drawing cooling air upwardly over the motor and outwardly from the cap in a relatively smooth air flow for efficient cooling of the motor 80. While the efficiency of the cooling may be enhanced with the wall 60, the opening 64, and the blower wheel 112, satisfactory cooling may also be obtained without the wall 60 and with a two or four, or more or less, bladed fan or paddle, using the circular elements and the airflow path discussed herein.

Figure 6:
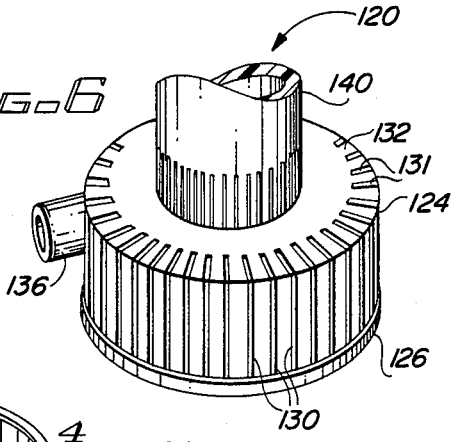
FIG. 6 is a perspective view of an alternate embodiment of a portion of the apparatus of the present invention.
Figure 7:
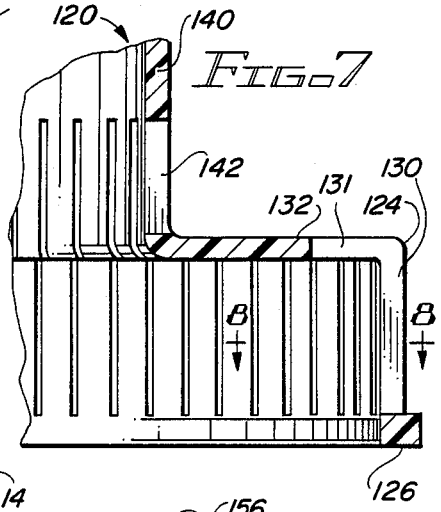
FIG. 7 is an enlarged view in partial section of a portion of the apparatus of FIG. 6.
Figure 8:
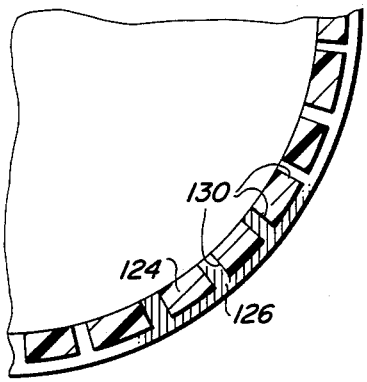
FIG. 8 is a view in partial section taken generally along line 8—8 of FIG. 7.

FIG. 6 is a perspective view of a portion of an alternate pump apparatus embodiment 120. FIG. 7 is an enlarged view in partial section of a portion of the pump apparatus 120 of FIG. 6. FIG. 8 is a view in partial section taken generally along line 8—8 of FIG. 7. The alternate embodiment 120 varies or differs from the pump apparatus 10 in that water intake slots extends substantially along the entire water intake portion of the apparatus, both upwardly and slightly radially inwardly, and also upwardly along the cylindrical shaft housing.

The alternate embodiment 120 includes a generally cylindrical water intake portion 124. A rim 126 extends circumferentially about the bottom of the water intake portion 124. Extending outwardly from the water intake portion 124 is a pump outlet 136.

A horizontal wall 132 extends inwardly at the top of the water intake portion 124 to a shaft housing 140. The shaft housing 140 extends upwardly from the wall 132. The shaft housing 140 is coaxially aligned or located with respect to the water intake portion 124.

Extending upwardly from the rim 126 of the water intake pump 124 is a plurality of water intake slots 130. The slots 130 extend upwardly from the rim 126 for the entire height of the water intake portion 124, and they extend continuously radially inwardly through the horizontal wall 132 for a predetermined radial distance. Another plurality of slots 142 extend axially upwardly on the shaft housing 140.

The predetermined radial distance varies so that the horizontal portion of the slots 130 do not extend into the top of the impeller housing within the water intake portion 124. See, for example, the cross-sectional illustration of the impeller housing 26 within the water intake housing 14, and the horizontal portions of the slots 16 which extend radially inwardly on the horizontal wall 22, as shown in FIG. 2. This is also true for the pump apparatus 120.

With the water intake slots 130 extending vertically continuously, circumferentially, about the water intake portion 124, radially inwardly along the wall 132, and with the slots 142 extending vertically upwardly along the shaft housing 140, a substantial amount of vibration dampening is accomplished. The slots act as a damper for dampening any vibration caused by a motor within the pump apparatus 120 to prevent the vibration from being transmitted to the cooler housing or other element in which the pump apparatus 120 is disposed.

Returning again to FIGS. 1 and 3, it will be noted that the vertical water intake slots 16 and 17 on the water intake portions 14 are shown differently in the two Figures. In FIG. 1, the slots 16 are shown similar to the slots 130 of FIGS. 6 and 7. In FIG. 3, the slots 17 extend only part way up the vertical wall of the water intake portion 14.

From the vibration dampening point of reference, the slots 16 and 23 of FIG. 1 are superior to the slots 17 of FIG. 3.

Figure 9:
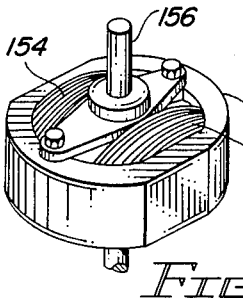
FIG. 9 is a perspective view of an alternate motor element usable in the apparatus of the present invention.

FIG. 9 is a perspective view of a motor 150, also usable with the apparatus of the present invention. The motor 150 includes a pair of coils 152 and 154 and a shaft 156. It will be noted that the motor 150 is symmetrical with respect to its shaft 156.

When a motor, such as the motor 150, is used with the pump apparatus 10 or the pump apparatus 120, the shaft 156 will be disposed centrally or coaxially with respect to the pump housing 50, the shaft housing 40, and the water intake portion 14, and with respect to the corresponding elements 140, 132, and 124 of the apparatus 120. Accordingly, the aperture 24 through the wall 22 will be centrally located, or concentric, with respect to the shaft housing 40 and to the wall 22. Moreover, the coved wall 62 and the opening 64 will be centrally or concentrically located with respect to the plate 60 and to the cap 70, if the plate 60 is used. When an offset motor, such as the motor 80, is used with the pump apparatus 10 or pump apparatus 120, due to the configuration of the motor, the shaft 90, the impeller 100, and the blower wheel 110 will necessarily be offset from the center of the apparatus and the apparatus will accordingly be offset from the center of the housing 12 and the cap 70. However, it will be noted that the pump apparatus 10, including the housing 12 and the cap 70, are generally circular or symmetrical in overall configuration. Similarly, the pump apparatus 120 is generally symmetrical. The interior elements will be configured according to the type of motor used in the apparatus.

Due to fluid dynamics, of course, the water outlet 26 will not be symmetrical, but will be generally tangentially located with respect to the flow of water from the impeller 100 and from the impeller housing 26. This is well known and understood.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Housing apparatus for a pump and a motor, comprising in combination:

bottom housing means for receiving water to be pumped, including a water intake portion having a first plurality of slots spaced apart from each other to allow water to flow through the slots and to prevent undesirable debris from flowing through the slots with the water;

middle housing means connected to and extending upwardly from the bottom housing means;

upper housing means secured to the middle housing means for receiving a motor, comprising a generally round motor housing and including a bottom wall;

passage means through which air flows for cooling the motor in the upper housing means;

a generally round cap secured to the upper housing means for receiving the air flowing into the upper housing means and from which the air flows out of the apparatus; and means disposed within the cap for causing the air to flow into the upper housing means, upwardly over the motor, and into and out of the round cap.

2. The apparatus of claim 1 in which the bottom housing means further includes an impeller housing into which the water flows.

3. The apparatus of claim 2 in which the base means further includes an impeller in the impeller housing for pumping water out of the bottom housing means.

4. The apparatus of claim 1 in which the bottom housing means further includes a generally horizontally extending top wall, and the middle housing means is secured to the top wall.

5. The apparatus of claim 4 in which the base means further includes a second plurality of slots extending through the top wall through which water flows.

6. The apparatus of claim 5 in which the middle housing means includes a third plurality of slots through which water flows.

7. The apparatus of claim 6 in which the first and second pluralities of slots are connected to each other for dampening vibrations.

8. The apparatus of claim 1 in which the motor includes an electric cord and the upper housing means includes strain relief means for the electric cord.

9. Evaporative cooler pump apparatus comprising, in combination, electric motor means;

round motor housing means for receiving the electric motor;

a shaft extending through the motor and rotatable to provide an output from the motor, including a first portion extending above the motor and a second portion extending below the motor;

shaft housing means secured to and extending below the round motor housing means through which the second portion of the shaft extends;

water intake base means connected to the shaft housing into which the second portion of the shaft extends and into which water flows;

a first horizontal wall on the water intake base means and on the shaft housing means and comprising a top wall for the water intake base and a bottom wall for the shaft housing;

an aperture in the horizontal wall through which the second portion of the shaft extends to provide communication between the shaft housing and the water intake base;

first slot means extending through the water intake base means to allow water to flow into the water intake base and to prevent debris from flowing into the water intake base means;

impeller means in the water intake base means for pumping water out of the water intake base means;

a cap disposed above the round motor housing means;

a second horizontal wall on the round motor housing means and on the shaft housing means to which the motor is secured;

passage means through which air flows into the round motor housing means, over the motor, and into the cap; and means disposed above the motor for causing the air to flow through the passage means, into the round motor housing means, over the motor, and into and out of the cap for cooling the electric motor.

10. The apparatus of claim 9 in which the shaft housing means includes second slot means allowing water to flow into the shaft housing means and through the aperture about the second portion of the shaft and into the water intake base means and preventing debris from flowing with the water into the shaft housing means.

11. The apparatus of claim 10 in which the shaft housing means includes anti-vortex fin means on the first horizontal wall about the aperture for preventing water vortices about the shaft and in the water intake base.

12. The apparatus of claim 11 in which the water intake base means includes third slot means in the first horizontal wall allowing water to flow into the water intake base means and straining debris from the flowing water.

13. The apparatus of claim 12 in which the first and third slot means are connected together to comprise vibration dampening elements for dampening vibration from the electric motor means.

14. The apparatus of claim 9 in which the impeller means includes an impeller secured to the second portion of the shaft for pumping water out of the water intake means.

15. The apparatus of claim 14 in which the impeller means further includes an impeller housing secured to the first horizontal wall within the water intake base means and disposed about the impeller.

16. The apparatus of claim 9 in which the electric motor means comprises a single pole offset motor asymmetrically disposed within the round motor housing means.

17. The apparatus of claim 9 in which the electric motor means comprises a double pole symmetrical motor.

18. The apparatus of claim 9 in which the round motor housing means includes a third horizontal wall disposed above the electric motor means and an opening in the third horizontal wall through which air flows into the cap.

19. The apparatus of claim 18 in which the third horizontal wall of the round motor housing means includes a coved wall about the opening through which air flows into the cap.

20. The apparatus of claim 19 in which the means for causing air to flow through the passage means and over the motor and into the cap includes blower means adjacent to the opening in the third horizontal wall.

21. The apparatus of claim 20 in which the blower means includes a plurality of blades extending about the coved wall.

22. The apparatus of claim 9 in which the electric motor includes an electric cord, and the round motor housing means includes strain relief means for the electric cord.

23. The apparatus of claim 22 in which the strain relief means includes a notch in the round motor housing means.

24. The apparatus of claim 23 in which the strain relief means further includes cord clamp means adjacent to the notch.

* * * * *